US005540753A

United States Patent [19]

Takano et al.

[11] Patent Number: 5,540,753

[45] Date of Patent: Jul. 30, 1996

[54] METHOD FOR REFINING CHROMIUM-CONTAINING MOLTEN STEEL BY DECARBURIZATION

[75] Inventors: Hironori Takano; Hiroaki Morishige; Ryuji Nakao; Toshihiro Kosuge, all of Hikari, Japan

[73] Assignee: Nippon Steel Corporation, Tokyo, Japan

[21] Appl. No.: 347,925

[22] Filed: Dec. 1, 1994

[30] Foreign Application Priority Data

Jul. 27, 1994 [JP] Japan ..... 6-175696

[51] Int. Cl.[6] ..... C21C 5/35

[52] U.S. Cl. ..... 75/551

[58] Field of Search ..... 75/548, 555, 551, 75/528

[56] References Cited

U.S. PATENT DOCUMENTS 3,854,932 12/1974 Bishop ..... 75/555

FOREIGN PATENT DOCUMENTS 55-158213 12/1980 Japan .

61-266516 11/1986 Japan .

*Primary Examiner*—Melvyn Andrews

*Attorney, Agent, or Firm*—Pennie & Edmonds

[57] ABSTRACT

The present invention provides a method for refining a molten chromium-containing steel by decarburization according to a combined-blown process, which contributes to an improvement in decarburization rate and realizes efficient decarburization while preventing [Cr] contained in the molten steel from being oxidized. The method is characterized in that, in a region where the [C] concentration of the molten chromium-containing steel is not less than 0.15%, oxygen or a gas mixture of oxygen with an inert gas is blown through a top-blown lance onto the surface of the molten steel under the following conditions:

(1) the velocity of the gas immediately after spouting through one or at least two nozzle holes of the top-blown lance is not less than the velocity of sound; and (2) the ratio of the length h of a zone, in the vicinity of the surface of the molten steel, where the gas jet velocity is less than the velocity of sound, to the minimum hole diameter $d_0$ of said nozzle, $h/d_0$, is not more than 60, provided that when gas jets blown through a multihole nozzle overlap each other with a degree of overlap β, a requirement represented by the formula $h/d_0 \times (1-\beta) \leqq 60$ is met.

15 Claims, 11 Drawing Sheets

METHOD FOR REFINING CHROMIUM-CONTAINING MOLTEN STEEL BY DECARBURIZATION

BACKGROUND OF THE INVENTION

1. Field of the Invention

The present invention relates to a method, for refining a chromium-containing molten steel by decarburization, which can improve the decarburization rate, prevent the oxidation of [Cr] contained in the molten metal and enable the molten steel to be decarburized with a high efficiency.

2. Description of the Prior Art

A chromium-containing steel, such as stainless steel, has hitherto been refined by a combined-blown process wherein an oxygen gas or an oxygen-containing gas (hereinafter referred to simply as "oxygen") or a gas mixture of oxygen with an inert gas is blown into a molten steel through a tuyere provided at the bottom of a furnace (a bottom-blown tuyere) and through a lance provided above the surface of the molten steel (a top-blown lance).

Japanese Unexamined Patent Publication (Kokai) Nos. 55-158213 and 61-266516 describe a method for efficiently decarburizing a molten steel while preventing the oxidation of chromium contained in the molten steel, wherein a secondary combustion reaction, which converts CO generated on the surface of a molten steel bath to $CO_2$, is positively allowed to proceed to raise the temperature of the molten steel by taking advantage of the heat of reaction, thereby preventing the formation of chromium oxide to reduce the Si content which is necessary for the reduction of chromium oxide in slag (unit requirenet of Si for reduction).

More specifically, Japanese Unexamined Patent Publication (Kokai) No. 55-158213 describes that oxygen or an inert gas is blown into below the surface of a molten steel bath to decarburize the molten steel while feeding, from above the molten steel, oxygen in an amount of at least 0.2 times the amount of oxygen fed into below the surface of the molten steel, allowing a secondary combustion reaction, which converts CO generated on the surface of a molten steel bath to $CO_2$, to positively raise the temperature of the molten steel by taking advantage of the heat of reaction, thereby preventing the formation of chromium oxide to reduce the amount of Si which is necessary for the reduction of chromium oxide in slag.

Japanese Patent Unexamined Patent Publication (Kokai) No. 61-266516 proposes the following formula representing the relationship between the proportion (P) of the top-blown oxygen, which reacts with the molten steel, in the top-blown oxygen, the lance height (L), and the velocity (V) of the top-blown oxygen blown through the lance and describes that a desired proportion of top-blown oxygen, which reacts with the molten steel, can be attained by blowing the top-blown oxygen at a velocity in the range of from 150 ft/sec (45.7 m/sec) to the velocity of sound:

$$P=K-1629(L/V)$$

wherein

P: the desired proportion of top-blown oxygen which reacts with the molten metal (%), K: a constant in the range of from 56 to 72, L: the height of the opening in the lance above the surface of the molten steel (ft), and V: the flow rate of oxygen blown through the lance (ft/sec).

Considering the fact that the secondary combustion reaction caused by top-blown oxygen is generally recognized as occurring at a flow rate of oxygen in a region of lower than the velocity of sound (a free jet region), it can be said that the method disclosed in Japanese Unexamined Patent Publication (Kokai) No. 61-266516 is intended to allow the secondary combustion reaction caused by the top-blown oxygen to positively proceed.

In all the above prior art, in order to improve the decarburization efficiency in refining a chromium-containing molten steel, the secondary combustion reaction caused by top-blown oxygen is positively allowed to proceed, and the temperature of the molten steel is raised by taking advantage of heat generated by the secondary combustion reaction. In order to raise the temperature of the molten steel by taking advantage of heat generated by the secondary combustion, it is necessary to ensure a supply of oxygen in an amount necessary for the secondary combustion. When the combined-blown process and the bottom-blown process are compared with each other under the same oxygen feed rate conditions, the necessary decarburization refining time for the combined-blown process is unfavorably longer than that for the bottom-blown process, because the amount of oxygen necessary for the secondary combustion for the combined blown process is larger than that for the bottom-blown process, causing the amount of oxygen, which reacts directly with carbon contained in the molten steel, to be reduced.

SUMMARY OF THE INVENTION

An object of the present invention is to provide a method for refining a chromium-containing molten steel, by decarburization, using a combined-blown process, wherein bottom-blown conditions and top-blown conditions are maintained in respectively suitable ranges to improve the decarburization efficiency and, at the same time, the oxidation of chromium contained in the molten steel is prevented to shorten the refining time and to reduce the amount of Si necessary for the reduction of chromium oxide.

Another object of the present invention is to directly react a top-blown gas (oxygen or a mixture of oxygen with an inert gas) with a molten steel, thereby reducing the top-blown oxygen consumption for the secondary combustion.

A further object of the present invention is to regulate, depending upon the [C] concentration of the molten steel, the depth of a recess formed by the top-blown gas on the surface of the molten steel or the rate of oxygen fed onto the high-temperature spot of contact between a top-blown gas jet and the surface of the molten steel, thereby accelerating the decarburization reaction.

A further object of the present invention is to reduce the amount of splash and dust attributable to a top-blown gas jet, thereby solving a problem of lowered yield and problems associated with operation.

According to the present invention, in order to solve the above problems, a gas is blown through a top-blown lance nozzle onto the surface of a molten steel in a region having a [C] concentration of not less than 0.15% so as to meet the following requirements:

(1) the velocity of the gas immediately after jet through the top-blown lance nozzle is not less than the velocity of sound; and (2) the velocity of the gas blown through said nozzle hole in the top-blown lance is less than the velocity of sound in the vicinity of the surface of the molten steel with the ratio of the length h of a zone, where the gas jet velocity is less than the sound velocity, to the minimum hole diameter $d_0$ of said nozzle, $h/d_0$, being not more than 60, thereby significantly accelerating the decarburization reaction and, at the same time, significantly lowering the secondary combustion rate.

Not only in the case where the nozzle of the top-blown lance has a single hole but also in the case where the nozzle has a plurality of holes, the gas is blown under the above conditions so far as the spot of contact between the gas jet and the surface of the molten steel is identical for each gas jet blown through the nozzle holes.

On the other hand, for gas jets blown through the multihole nozzle, when the spot of contact between one gas jet and the surface of the molten steel is not identical to but overlaps the spot of contact between another gas jet and the surface of the molten steel, the gas is blown so as to meet the requirement $h/d_0\times(1-\beta)\leqq 60$ wherein $\beta$ represents the degree of overlap.

Further, according to the present invention, the temperature of the molten steel before the initiation of the decarburization in the combined-blown process is maintained above the equilibrium molten steel temperature to improve the decarburization efficiency and to lower the unit requirenet of Si for reduction.

In the present invention, in order to accelerate the decarburization reaction at the high-temperature spot of contact between the gas jet and the surface of the molten steel (hereinafter referred to simply as "hot spot"), the depth of a recess formed by the top-blown gas on the surface of the molten steel is made to not less than 300 mm in a region where the [C] concentration is not less than 0.5%, and 70 to 300 mm in a region where the [C] concentration is 0.15 to less than 0.5%. Oxygen is fed according to the rate of decarburization reaction at the hot spot. In this case, the oxygen flow rate is regulated by the [C] concentration of the molten steel and the gas jet contact area S (area of the hot spot) to accelerate the decarburization reaction.

Specifically, when oxygen or a gas mixture of oxygen with an inert gas is blown onto the surface of a molten steel through a top-blown lance, the ratio of the rate of flow Of oxygen $FO_2$, which gives rise to a decarburization reaction on the surface of the molten steel, in the top-blown oxygen to the contact area S between the top-blown gas jet and the surface of the molten steel, that is, $FO_2/S$ value, secures 60 $Nm^3/min/m^2$ at the least and is regulated as near as possible to this value, in a region where the [C] concentration is not less than 0.5%, and 10 to 40 $Nm^3/min/m^2$ in a region where the [C] concentration is 0.15 to less than 0.5%, thereby accelerating a decarburization reaction at a hot spot formed on the surface of the molten steel, and, at the same time, a multihole nozzle is used to increase the gas jet contact area and to reduce the density of oxygen fed to the hot spot ($FO_2/S$), thereby preventing the occurrence of dust and splash.

Further, in the present invention, the proportion of the top-blown gas (=flow rate of top-blown oxygen×100/(flow rate of top-blown oxygen+flow rate of bottom-blown oxygen)) is adjusted to 20 to 70% to increase $dC/dO_2$ (decarburization per $Nm^3$ of oxygen), shorten the decarburization refining time, and lower the unit requirement of Si for reduction.

DESCRIPTION OF THE PREFERRED EMBODIMENTS

Figure 1B:
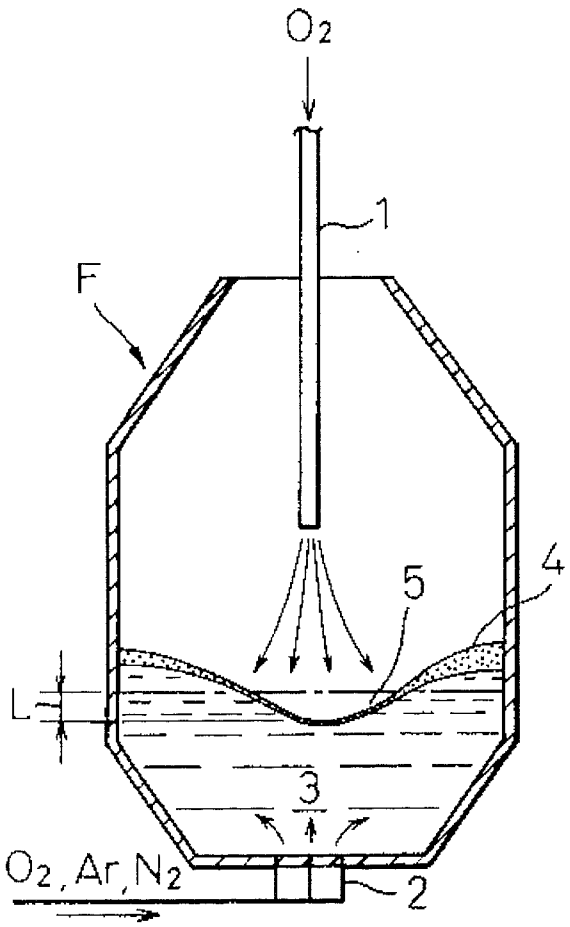
FIG. 1(B) is a front cross-sectional view showing the state, during blowing, of the combined-blown furnace shown in FIG. 1(A)
Figure 1A:
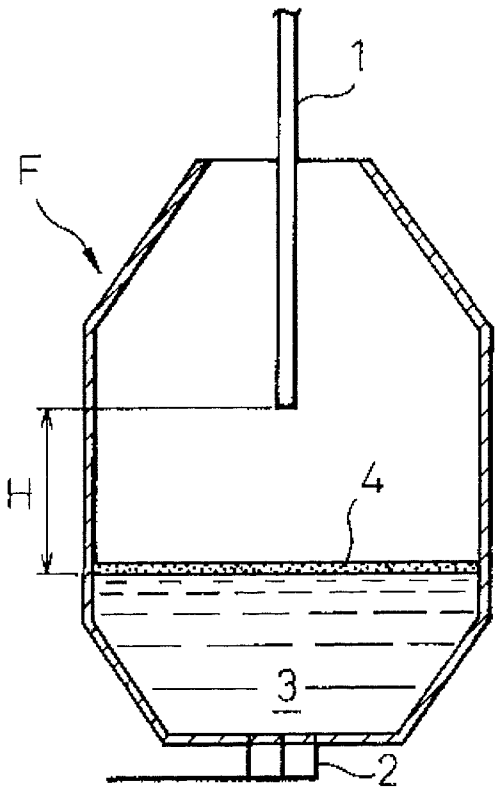
FIG. 1(A) is a front cross-sectional view showing the state, before the initiation of blowing, of a combined-blown furnace for practicing the present invention.

A combined-blown process as shown in FIGS. 1(A) and (B) is used in the method for refining a chromium-containing molten steel by decarburization according to the present invention. FIG. (A) shows a stationary state of a molten steel before blowing a gas, and FIG. 1(B) shows a state of the molten steel during the blowing of a gas. In the drawings, numeral 1 designates a top-blown lance, numeral 2 a bottom-blown double-pipe tuyere, numeral 3 a molten steel, and numeral 4 slag. Into the molten steel 3 contained in a lower part of a combined-blown furnace, is blown oxygen or oxygen in combination with an inert gas through a top-blown lance 1, and oxygen or oxygen in combination with an inert gas through an inner pipe of the bottom-blown double-pipe tuyere 2 with a protective gas (Ar gas or the like) for cooling the tuyere being blown through an outer pipe. In the drawing, numeral 5 designates a gas jet contact point formed on the surface of the molten steel by blowing oxygen through a top-blown lance 1.

The process for the decarburization refining of a chromium-containing molten steel generally comprises the step of oxidizing and removing [C] contained in a molten steel by a decarburization reaction represented by the following formulas (1) and (2) (oxidation period) and the step of placing a reducing material (for example, Fe—Si or A1) within the furnace in order to reduce chromium oxide produced in the oxidation period, and a slag-forming material (for example, CaO or $CaF_2$) to reduce and recover chromium oxide by taking advantage of the following reaction (3) or (4) (reduction period):

<Oxidation period>

$$2\underline{Cr}+3/2O_2=(Cr_2O_3) \quad (1)$$

$$(Cr_2O_3)+3\underline{C}=2\underline{Cr}+3CO \quad (2)$$

<Reduction period> where Fe—Si is used, $$2(Cr_2O_3)+3Si=4\underline{Cr}+3(SiO_2) \quad (3)$$

where Al is used, $$2(Cr_2O_3)+4Al=4\underline{Cr}+2(Al_2O_3) \quad (4)$$

In the oxidation period, it is a common practice to use a high molten steel temperature (1600° C. or above) in order to accelerate the reaction represented by the formula (2) for the purpose of preventing the production of a large amount of chromium oxide and, at the same time, to increase the proportion of an inert gas (dilution ratio) in oxygen and an inert gas blown through a top-blown lance or a bottom-blown double pipe tuyere so that the partial pressure of CO gas ($P_{co}$) is lowered with a lowering in [C] concentration of the molten steel. On the other hand, since major factors effecting the cost of refining of a chromium-containing molten steel by decarburization are Ar gas, Fe—Si, and refractory material, it is important to minimize the occurrence of chromium oxide during the oxidation period and, at the same time, to shorten the decarburization refining time for the purpose of minimizing the amount of an inert gas used, such as Ar, and the melt loss of the refractory material, which increases in proportion to the decarburization refining time.

According to the present invention, in decarburization refining of a chromium-containing molten steel by the combined-blown process having the above features, in a region where the carbon concentration of the molten steel is not less than 0.15%, a protective gas for preventing the melt loss of a tuyere is blown through an outer pipe of a bottom-blown double-pipe tuyere with oxygen or oxygen in combination with an inert gas being blown through an inner pipe of the bottom-blown double-pipe tuyere, thereby positively stirring the molten steel to enhance the flow of the molten steel on its surface, and, at the same time, oxygen or oxygen in combination with an inert gas is blown onto the surface of the molten steel through a top-blown lance to form a hot spot on the surface of the molten steel to prevent the top-blown oxygen from being used for the secondary combustion of CO, thereby increasing the proportion of the top-blown oxygen which reacts with carbon contained in the molten steel, so that the decarburization efficiency is further improved over that in the conventional combined-blown process, thus shortening the decarburization refining time and reducing the unit requirenet of Si (or unit requirenet of Al) for reduction.

In the combined-blown process, when oxygen is usefully blown onto the surface of a molten steel to form a hot spot, the decarburization reaction on the surface of the molten steel is carried out at a high temperature, which significantly accelerates the decarburization reaction. In other words, the decarburization efficiency can be improved by feeding oxygen through a top-blown lance in such a manner that the amount of oxygen consumed in the secondary combustion is reduced while increasing the amount of oxygen, which directly reacts with the molten steel, to accelerate the formation of a hot spot.

It is said that top-blown oxygen gives rise to a secondary combustion reaction when a surrounding CO gas is curled in a region where the velocity of the top-blown oxygen is not more than the velocity of sound 330 m/sec (a free jet region). Therefore, in order to prevent the secondary combustion, it is necessary to limit the free jet region.

When the rate of flow of oxygen blown through the top-blown lance is identical, the smaller the height of the lance and the longer the supersonic region (jet core region) in the velocity of blown oxygen, the shorter the free jet region and the smaller the proportion of top-blown oxygen consumed in the secondary combustion of CO.

Figure 2:
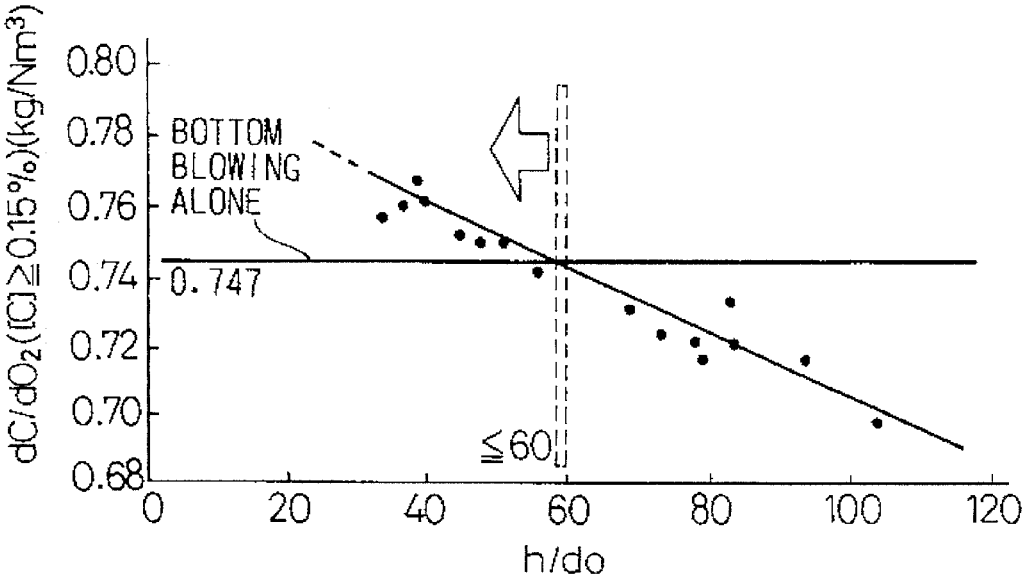
FIG. 2 is a diagram showing the relationship between $h/d_0$ and $dC/dO_2$.
Figure 3:
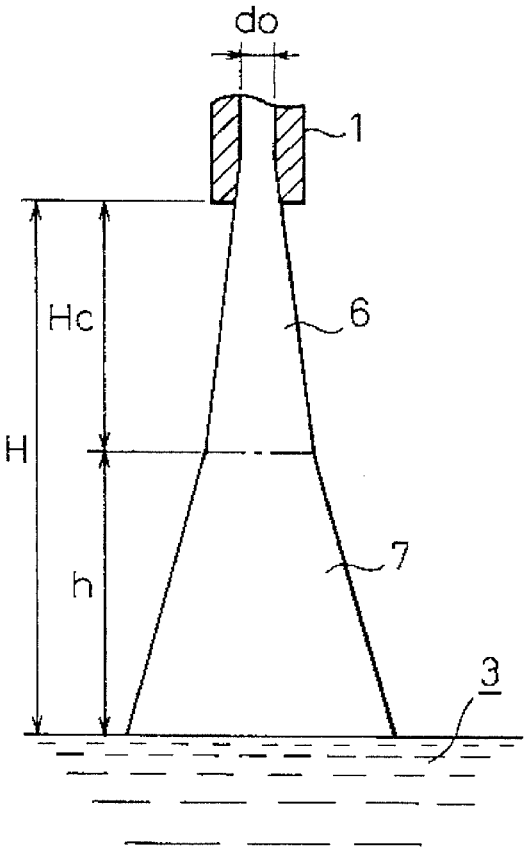
FIG. 3 is a diagram showing the spread of a gas blown through a top-blown lance.

FIG. 2 shows the degree of decarburization per $Nm^3$ of oxygen, i.e., $dC/dO_2$, in the case of $[C\%]\geqq 0.15$ when the combined-blown process is carried out under conditions of $[C\%]\geqq 0.15$ with the total oxygen flow rate being varied in the range of from 4000 to 9000 $Nm^3$/hr and the $h/d_0$ being varied as shown in FIG. 3. It is apparent that the $dC/dO_2$ is significantly improved when $h/d_0\leqq 60$. In this case, the $dC/dO_2$ improves with reducing the $h/d_0$.

$h/d_0$, as shown in FIG. 3, is a measure of the length of a free jet region 7 which is present in the vicinity of a molten steel 3 and derived by the following formulas (5) and (6) . In the drawing, numeral 6 designates a jet core region (a supersonic region) immediately after a gas leaves a nozzle 1.

$$h/d_0=H/d_0-Hc/d_0 \quad (5)$$

$$Hc/d_0=4.12Pa-1.86 \quad (6)$$

wherein h: free jet length (mm),

H: lance gap (mm),

Hc: jet core length (supersonic region length) (mm),

Pa: top-blown gas blowing pressure ($kg/cm^2$), and $d_0$: nozzle hole diameter of top-blown lance (mm).

On the other hand, $dC/dO_2$ represents the degree of decarburization per $Nm^3$ of top-blown or bottom-blown oxygen. The larger the $dC/dO_2$, the higher the decarburization rate and the decarburization efficiency and thus the shorter the decarburization refining time and the better the unit requirenet of Si for reduction. For this reason, in the present invention, the $h/d_0$ value is brought to not more than 60 to enhance the $dC/dO_2$. In this connection, it is noted that in order to prevent the occurrence of dust and splash, it is preferred to regulate the $h/d_0$ value to the range of from 20 to 60.

Figure 4:
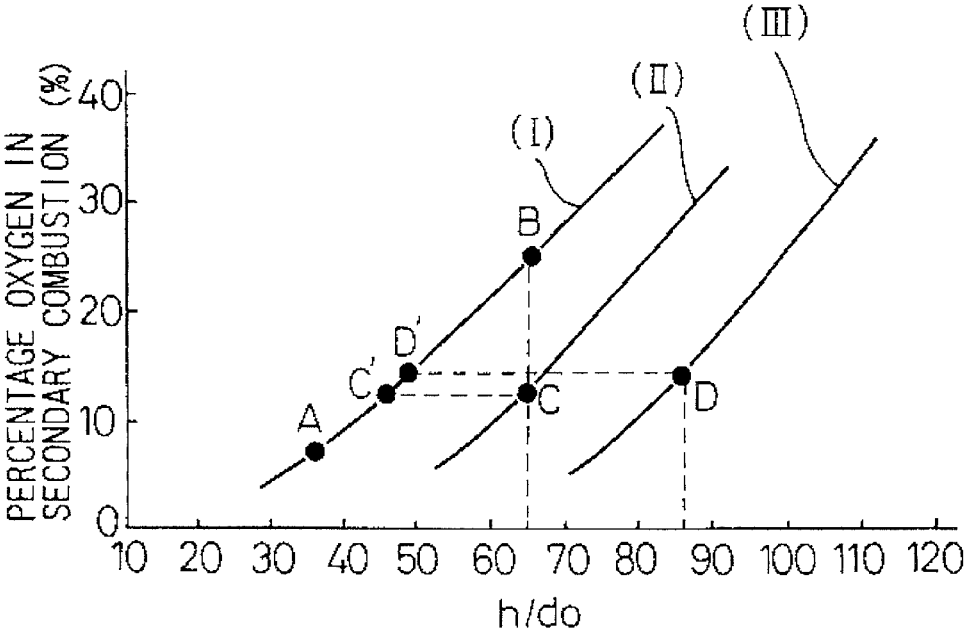
FIG. 4 is a diagram showing the relationship between the $h/d_0$ and the proportion of oxygen in secondary combustion.

FIG. 4 is a diagram showing the relationship between the secondary combustion oxygen ratio, which is the proportion of the amount of oxygen consumed in a secondary combustion reaction in top-blown oxygen, and the $h/d_0$ when a combined-blown process is carried out under various top-blown conditions using various top-blown nozzles. As is apparent from FIG. 4, the proportion of the amount of oxygen consumed in the secondary combustion increases with increasing the $h/d_0$. In FIG. 4, points A, B, C, and D are plots of the $h/d_0$ against the proportion of oxygen consumed in secondary combustion in the top-blown oxygen for each nozzle listed in Table 1.

Table 1 shows the $h/d_0$ and the degree of overlap ($\beta$) of gas jet contact points described below under conditions of a top-blown gas flow rate of 4000 $Nm^3/hr$ and a lance gap H (see FIG. 3) of 2 m, and value of $h/d_0\times(1-\beta)$, which is a value of $h/d_0$ corrected for $\beta$. From FIG. 4 and Table 1, it is also apparent that, for a multihole nozzle, when the $h/d_0$ for the multihole nozzle is corrected for the degree of overlap $\beta$ to convert the $h/d_0$ to a value for a single hole (when gas jets blown through a multihole nozzle do not form a plurality of overlapped gas jet contact planes (planes of the hot spot) on the surface of the molten steel but form only one gas jet contact plane, such a nozzle is regarded as a single hole nozzle) and the corrected $h/d_0$ value is brought to not more than 60, the proportion of oxygen consumed in secondary combustion in the top blown oxygen can be reduced. Although the use of a multihole nozzle increases the $h/d_0$ value, the proportion of oxygen consumed in secondary combustion in the top blown oxygen can be regulated to a low value by blowing the top-blown gas so as to form overlapped gas jet contact planes on the surface of the molten steel.

TABLE 1

| Classification | Nozzle diameter (mmϕ) | Number of nozzle holes | Degree of overlap (β) | $h/d_0$ | $h/d_0$x (1-β) | Proportion of oxygen consumed in secondary combustion in top-blown oxygen (%) |
|---|---|---|---|---|---|---|
| A | 37 | 1 | 0 | 36.5 | 36.5 | 6.0 |
| B | 21 | 2 | 0 | 65.3 | 65.3 | 25.0 |
| C | | 2 | 0.31 | 65.3 | 45.1 | 12.0 |
| D | 17.2 | 3 | 0.43 | 86.6 | 49.4 | 14.0 |

Specifically, in FIG. 4, three lines (I), (II), and (III) respectively show a line in the case where a plane of contact between a gas jet blown through a lance nozzle and the surface of the molten steel is identical but not overlapped ($\beta$=0)(line (I)), a line in the case where the lance nozzle has two holes and overlap of the gas jet contact planes is observed ($\beta$=0.31)(line (II)), and the lance nozzle has three holes and overlap of the gas jet contact planes is observed ($\beta$=0.43) (line (III)).

In the drawing, point A is a point representing the proportion of oxygen consumed in secondary combustion corresponding to $h/d_0$=36.5 for a 37 mm nozzle diameter×1 hole. Point B is a point for a 21 mm nozzle diameter×2 holes. In this case, since the degree of overlap $\beta$ is zero (0), the point B is on the line (I) corresponding to $h/d_0$=65.3. Under these conditions of B, when the overlap ratio $\beta$ is 0.31, point B is shifted to point C on line (II). When the above $h/d_0$=65.3 is corrected for $\beta$ using the equation $h/d_0(1-\beta)$, $h/d_0(1-0.31)$ is 45.1 which is plotted as point C' on line (I).

Similarly, point D represents the proportion of oxygen consumed in secondary combustion corresponding to $h/d_0$= 86.6 for a 17.2 mm nozzle diameter×3 holes with the overlap ratio $\beta$=0.43. When the $h/d_0$ value is corrected for $\beta$ using the equation $h/d_0(1-\beta)$, $h/d_0(1-0.43)$ is 49.4 which is plotted as point D' on line (I).

Therefore, even in the case of an identical nozzle, blowing the top-blown gas so that gas the jet contact planes overlap each other enables the proportion of oxygen consumed in secondary combustion to be reduced as shown in FIG. 4 wherein point B is shifted to point C. In this case, the $h/d_0$ for a multihole nozzle can be converted to that for a single hole nozzle so that the corrected value is regulated to not more than 60.

Figure 5A:
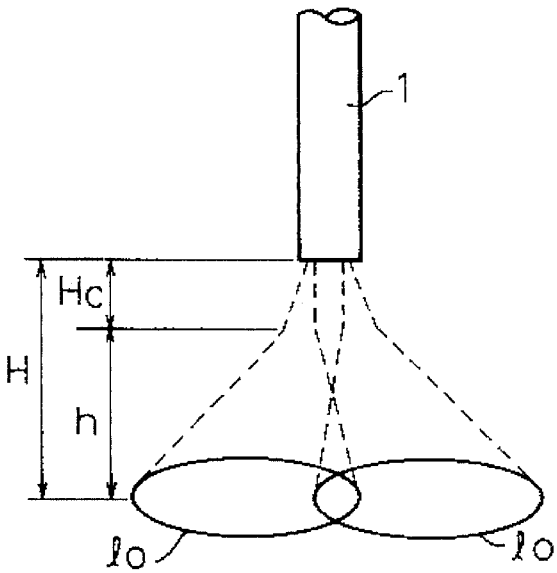
FIG. 5(A) is a diagram showing a gas jet contact plane between gas jets blown through a two-hole nozzle of a top-blown lance and the surface of a molten steel bath.
Figure 5B:
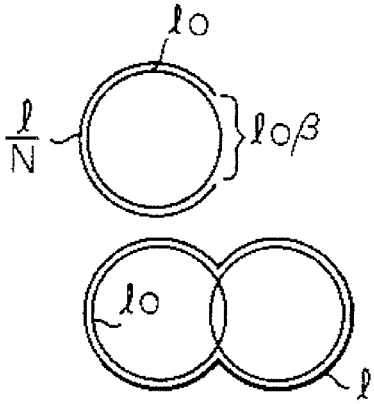
FIG. 5(B) is a diagram showing the perimeter of a plane of contact between the gas jets blown through the two-hole nozzle and the surface of the molten steel.

The degree of overlap $\beta$ will now be described. FIGS. 5(A) and (B) show gas jets formed in the case of a two-hole nozzle. More specifically, FIG. 5(A) shows a gas jet contact plane formed on the surface of the molten steel by gas jets blown through a top-blown lance nozzle. As shown in FIG. 5(B), when the perimeter of a gas jet contact plane formed on the surface of the molten steel by a gas jet blown through one nozzle is $l_0$, the perimeter of a contact plane formed on the surface of the molten steel by gas jets blown through all nozzles is l and the number of nozzle holes of a top-blown lance is N, the degree of overlap ($\beta$) of the perimeter $l_0$ of the contact plane formed on the surface of the molten steel by a gas jet blown through one nozzle with the perimeter l of other contact plane is expressed by the formula (7):

$$l_0=l/N+l_0\beta$$

$$\beta=(l_0N-l)/N/l_0 \quad (7)$$

wherein $l_0$: perimeter of a gas jet contact plane formed on the surface of a molten steel by a gas jet blown through one nozzle;

N: number of nozzle holes; and l: perimeter of a gas jet contact plane formed on the surface of a molten steel by gas jets blown through all nozzles.

As described above, accurate regulation of $h/d_0$ is a fundamental requirement of the present invention. In order to accurately set the lance gap H and to stably maintain the jet core region length Hc, it is necessary to use a water-cooled top-blown lance free from melt loss and a change in shape.

In order to efficiently improve the decarburization rate by top-blown gas, it is preferred for oxygen contained in the top-blown gas to react directly with a molten steel. For this purpose, the proportion of the oxygen consumed by CO in secondary combustion should be reduced. It is generally recognized by those skilled in the art that the secondary combustion reaction of the top-blown gas occurs when a surrounding CO gas is curled in a region where the velocity of the top-blown gas is not more than the velocity of sound 330 m/sec (a free jet region). Therefore, in order to prevent secondary combustion, it is necessary to limit the free jet region.

When the rate of flow of oxygen blown through the top-blown lance is identical, the smaller the height of the lance and the longer the supersonic region (jet core region Hc) in the velocity of blown oxygen, the smaller the free jet region length h and the smaller the proportion of oxygen in top-blown gas consumed in the secondary combustion by CO. Further, the jet core region length Hc is influenced also by the shape of the nozzle through which oxygen gas is blown. When the nozzle has a shape determined by taking the cubic expansion of the gas into consideration, the jet core region length Hc is long and reduces the amount of oxygen consumed in secondary combustion. Therefore, the shape of the nozzle of the top-blown lance should be taken into consideration, in addition to the combined-blown conditions for improving the decarburization rate and the decarburization efficiency.

Figure 6A:
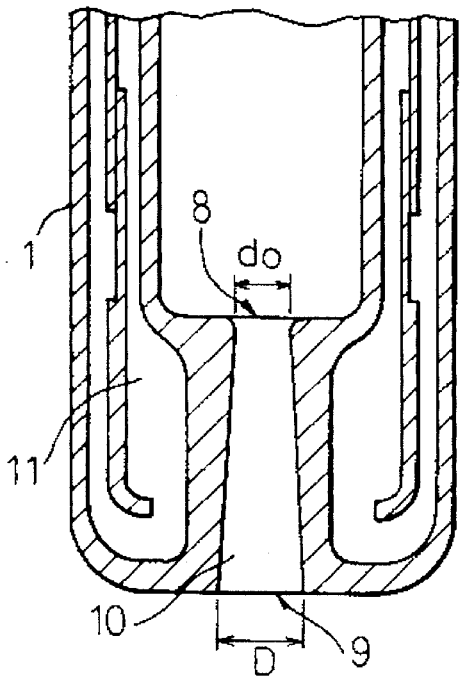
FIG. 6(A) is a cross-sectional view showing the shape of a single hole nozzle of a top-blown lance.
Figure 6B:
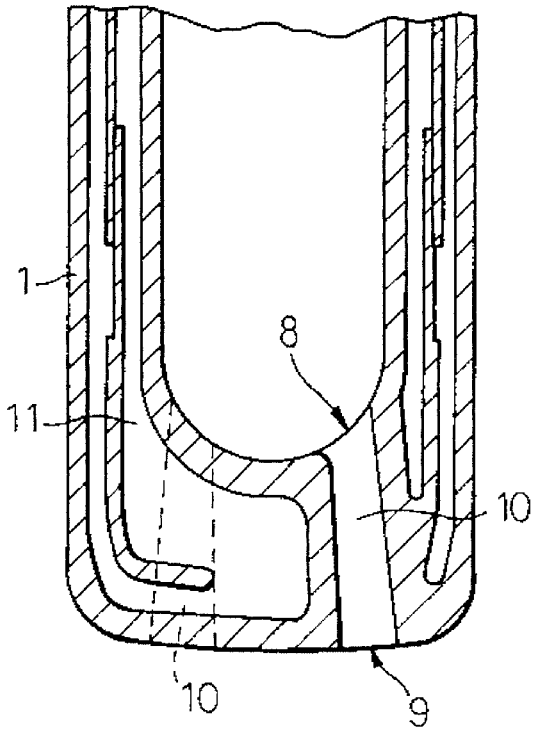
FIG. 6(B) is a cross-sectional view showing the shape of a multihole nozzle of a top-blown lance.

FIGS. 6(A) and FIG. 6(B) are diagrams showing nozzle shapes of lances used in the present invention, wherein FIG. 6(A) is a diagram showing a nozzle shape of a single hole nozzle and FIG. 6(B) is a diagram showing a nozzle shape of a multihole nozzle. In the drawing, nozzle 10 is in a divergent form (Laval nozzle) with the cubic expansion of gas being taken into consideration, wherein a the gas jet hole diameter 9 is larger than the minimum hole diameter ($d_0$) 8 of the nozzle.

Numeral 11 designates a passage for cooling water, and a water cooling mechanism is provided outside the lance.

The results of a comparison of a Laval nozzle with a straight nozzle on the jet core region length (Hc) and the free jet region length (h) under conditions of a minimum nozzle diameter of 22.5 mmø, a single hole, an oxygen flow rate of 2000 $Nm^3$/hr, and a lance height of 2000 mm for the lance shown in FIG. 6(A), and the results of a comparison of a Laval nozzle with a straight nozzle on the jet core region length (Hc) and the free jet region length (h) under conditions of a minimum nozzle diameter of 21.0 mmø, two holes, an oxygen flow rate of 3500 $Nm^3$/hr, and a lance height of 2000 mm for the lance shown in FIG. 6(B) are given in Table 2. It is apparent that, in both comparisons, the Laval nozzle has a smaller free jet length (h) and can reduce the amount of oxygen consumed in secondary combustion.

TABLE 2

| No. | Shape of nozzle | Nozzle diameter (mmϕ) | Gas jet hole diameter (mmϕ) | Number of nozzle holes | Hc (mm) | h (mm) |
|---|---|---|---|---|---|---|
| 1 | Laval nozzle | 22.5 | 28 | 1 | 574 | 1426 |
| 2 | Straight nozzle | 22.5 | 22.5 | 1 | 0 | 2000 |
| 3 | Laval nozzle | 21 | 26.3 | 2 | 537 | 1463 |
| 4 | Straight nozzle | 21 | 21 | 2 | 0 | 2000 |

As described above, $h/d_0$ is regulated to not more than for the purpose of preventing top-blown oxygen from being consumed in secondary combustion. The regulation of $h/d_0$ is carried out by properly designing the number of nozzle holes, the hole diameter, and the degree of overlap (β) of gas jets according to the flow rate of the top-blown gas and using a Laval nozzle as the nozzle to shorten the free jet region length. Further, in this case, since the lance gap at the time of top-blown operation should be set small with high accuracy, the lance should have a water-cooled structure free from melt loss. The above means can stably regulate the $h/d_0$ value to not more than 60, thus enabling the amount of oxygen consumed in secondary combustion to be reduced and controlled as desired.

Regarding a more specific example of means for bringing the $h/d_0$ value to not more than 60, the conditions were a top-blown oxygen flow rate of 3500 $Nm^3$/hr, a Laval nozzle with a diameter of 37.0 mm×single hole, and a lance gap of 2 m. The $h/d_0$ value was 39.

The relationship between the depth of a recess formed on the surface of the molten steel by the top-blown gas jet and the dCr/dC representing the degree of decarburization reaction will now be described.

Figure 7:
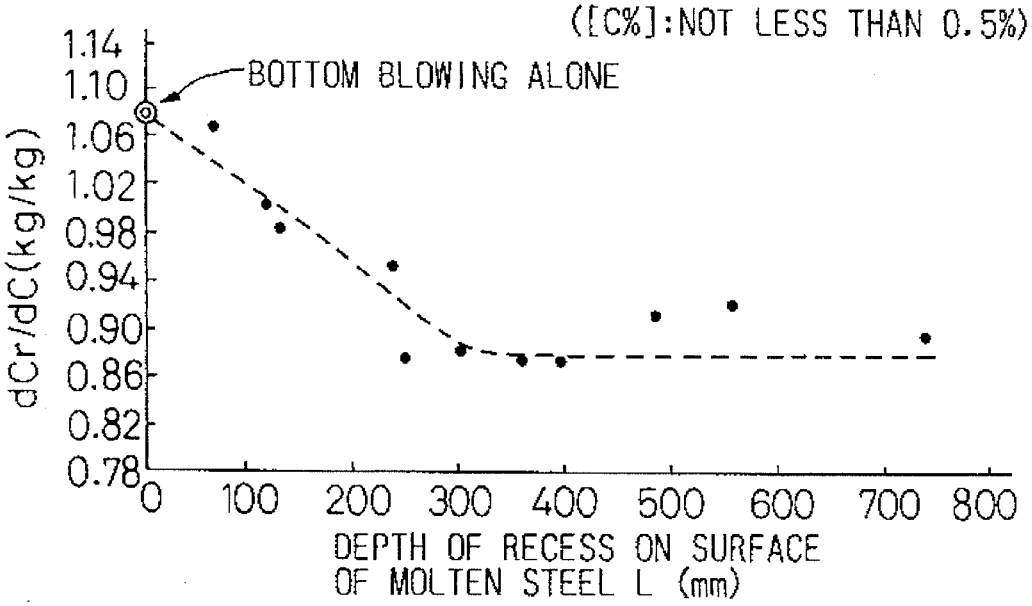
FIG. 7 is a diagram showing the relationship between the dCr/dC and the depth of a recess formed on the surface of a molten steel when $[C\%]\geqq 0.5\%$.

The relationship between the depth of a recess and the dCr/dC under combined-blown conditions in a region where the [C] concentration of the molten steel [C%] is not less than 0.5% is shown in FIG. 7.

The dCr/dC represents the amount (kg) of oxidized Cr per kg of C, and the depth (L) of the recess formed on the surface of the molten steel can be calculated by the following equations (8) and (9).

$$L=L_h \times e \times p(-0.78H/L_h) \quad (8)$$

$$L_h=63.0\times(O_r/nd_0)^{2/3} \quad (9)$$

wherein

L: the depth of a recess formed on the surface of the molten steel by a top-blown gas (mm), H: lance gap (distance between lance and the surface of the molten steel )(mm), $O_r$: the flow rate of the top-blown gas ($Nm^3$/hr), n: the number of nozzle holes of the top-blown lance, and $d_0$: the nozzle hole diameter of the top-blown lance (mm).

The dCr/dC becomes a minimum when L is not less than 300 mm. When consideration is given to the fact that L represents the energy of impingement of the top-blown gas jet against the surface of the molten steel, this is considered to represent the rate of oxygen fed to a hot spot formed on the surface of the molten steel by the top-blown gas. In order to accelerate the decarburization reaction at the hot spot, the L value should be not less than 300 mm. However, it is preferably in the range of from 300 to 700 mm from the viewpoint of preventing the occurrence of dust and splash by top blowing.

Figure 8:
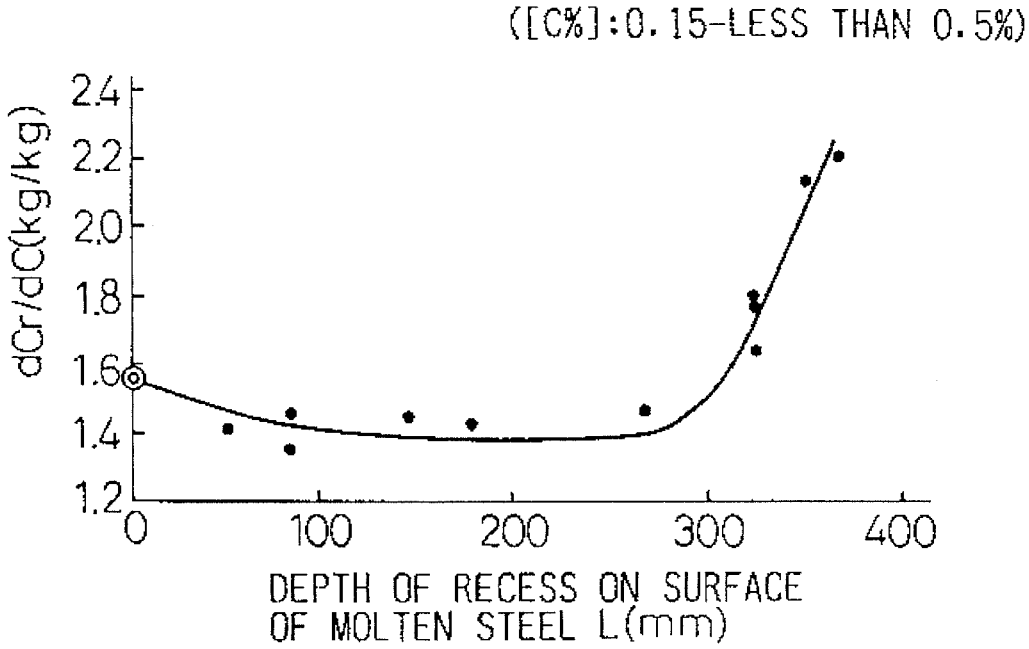
FIG. 8 is a diagram showing the relationship between the dCr/dC and the depth of a recess formed on the surface of a molten steel when $0.15\% \leqq [C\%]<0.5\%$.

FIG. 8 iS a diagram showing the relationship between the dCr/dC and the depth of a recess formed on the surface of the molten steel by a top-blown gas jet under combined-blown conditions in a region where the [C%] of the molten steel is in the range of from 0.15 to less than 0.5%.

The dCr/dC becomes a minimum when L is in the range of from 70 to 300 mm. The reason for this is thought to be that an oxygen flow rate that brings the L value to not less than 300 mm renders the amount of oxygen fed excessive, resulting in an increase in oxidation of Cr.

Further, in order for the top-blown oxygen to cause a reaction at the hot spot on the surface of the molten steel with a high decarburization efficiency, it is necessary to feed oxygen according to the decarburization reaction rate at the hot spot. As expressed in terms of the difference between the equilibrium value, determined by the temperature of the molten steel, pressure, and ingredients of the molten steel, and the found value and the rate capacity coefficient of reaction, the decarburization reaction rate increases with increasing the reaction interface area, so that the flow rate of the top-blown oxygen should be regulated by the [C%] of the molten steel and the gas jet contact area. The term "gas jet contact area" used herein means the gas jet contact area (S) formed on the surface of the molten steel by a gas jet blown through the top-blown lance nozzle shown in FIG. 5(A). The gas jet contact area (S) is defined by the equation (10) using the contact area (s) which is formed on the surface of the molten steel by a gas jet blown through a single nozzle, the number of nozzle holes (N), and the degree of overlap (α) of gas jet contact areas:

$$S=\alpha\times s\times N \quad (10)$$

When the flow rate of the top-blown oxygen is $FO_2$, the density of oxygen ($FO_2/S$) fed to the gas jet contact area (S) formed on the surface of the molten steel can be defined by the following equation (11) using the equation (10).

$$FO_2/S=FO_2/(\alpha\times s\times N) \quad (11)$$

Figure 9:
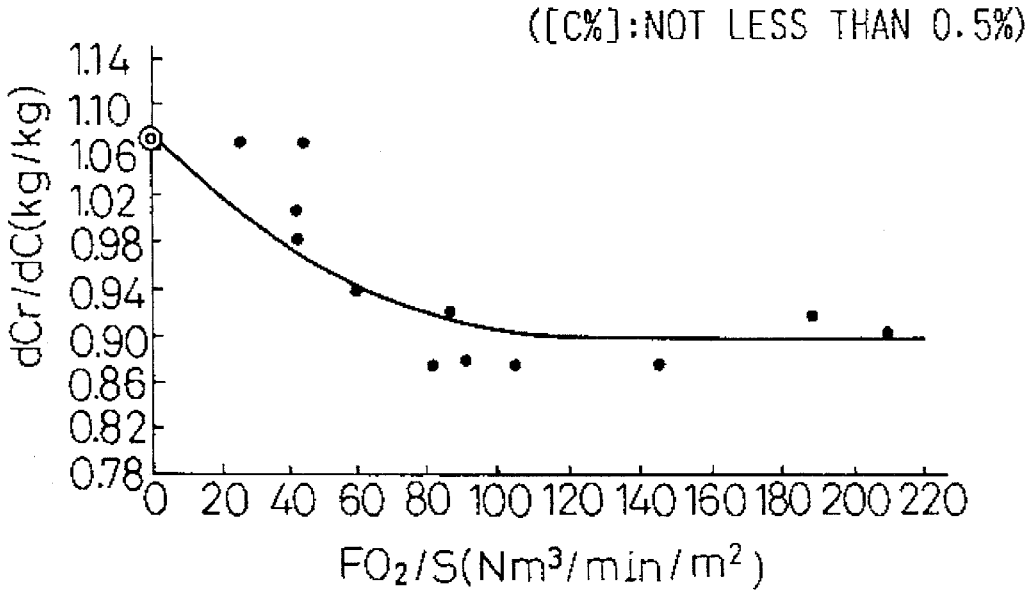
FIG. 9 is a diagram showing the relationship between the dCr/dC and the $FO_2/S$ when $[C\%]\geqq 0.5\%$.

FIG. 9 is a diagram showing the relationship between the dCr/dC and the $FO_2/S$ by a top-blown gas jet under combined-blown conditions in a region where the [C%] of the molten steel is not less than 0.5%. The dCr/dC is stably kept at a low value in a region where the $FO_2/S$ is not less than 60Nm$^3$/min/m$^2$, suggesting that, in a high carbon region of not less than 0.5%, except for the limitation derived from the amounts of dust and splash generated due to the decarburization reaction on the surface of the molten steel, decarburization refining can be carried out while preventing the oxidation of Cr even in the case of increased $FO_2/S$ values. For this reason, the $FO_2/S$ value is preferably in the range of from 60 to 400 Nm$^3$/min/m$^2$ from the viewpoint of lowering the dCr/dC value while reducing the amounts of dust and splash generated.

Figure 10:
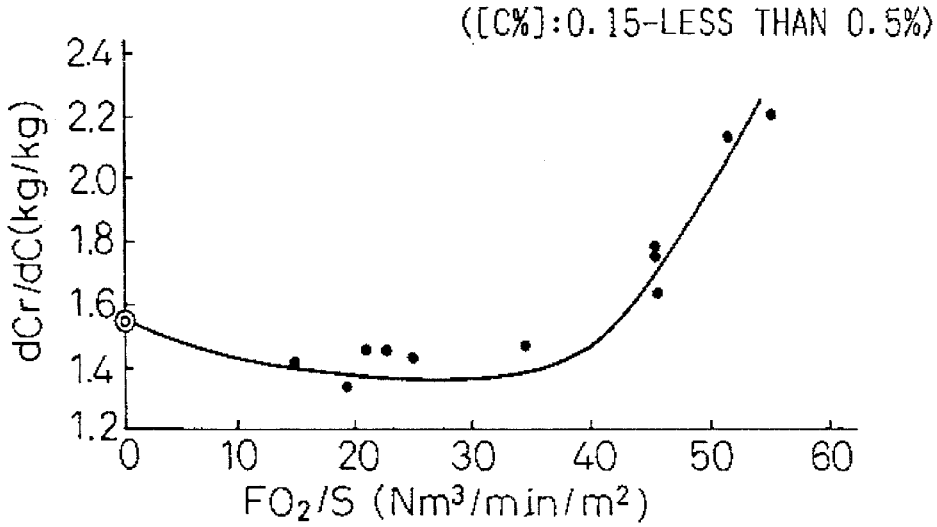
FIG. 10 is a diagram showing the relationship between the dCr/dC and the $FO_2/S$ when $0.15\% \leqq [C\%]<0.5\%$.

FIG. 10 is a diagram showing the relationship between the dCr/dC and the $FO_2/S$ under combined-blown conditions in a region where the [C%] of the molten steel is 0.15% to less than 0.5%. The dCr/dC is stably kept at a low value in a region where the $FO_2/S$ is in the range of from 10 to 40 Nm$^3$/min/m$^2$, suggesting that, in the region where the [C%] of the molten steel is 0.15% to less than 0.5%, the regulation of the $FO_2/S$ value according to the reaction rate of decarburization at the hot spot of the top-blown gas jet is important to the prevention of the oxidation of Cr. Thus, in the region where the [C] concentration is in the range of from 0.15 to less than 0.5%, the regulation of the $FO_2/S$ value to a relatively low range of from 10 to 40 Nm$^3$/min/m$^2$ enables the prevention of dusting and the acceleration of decarburization.

Figure 11:
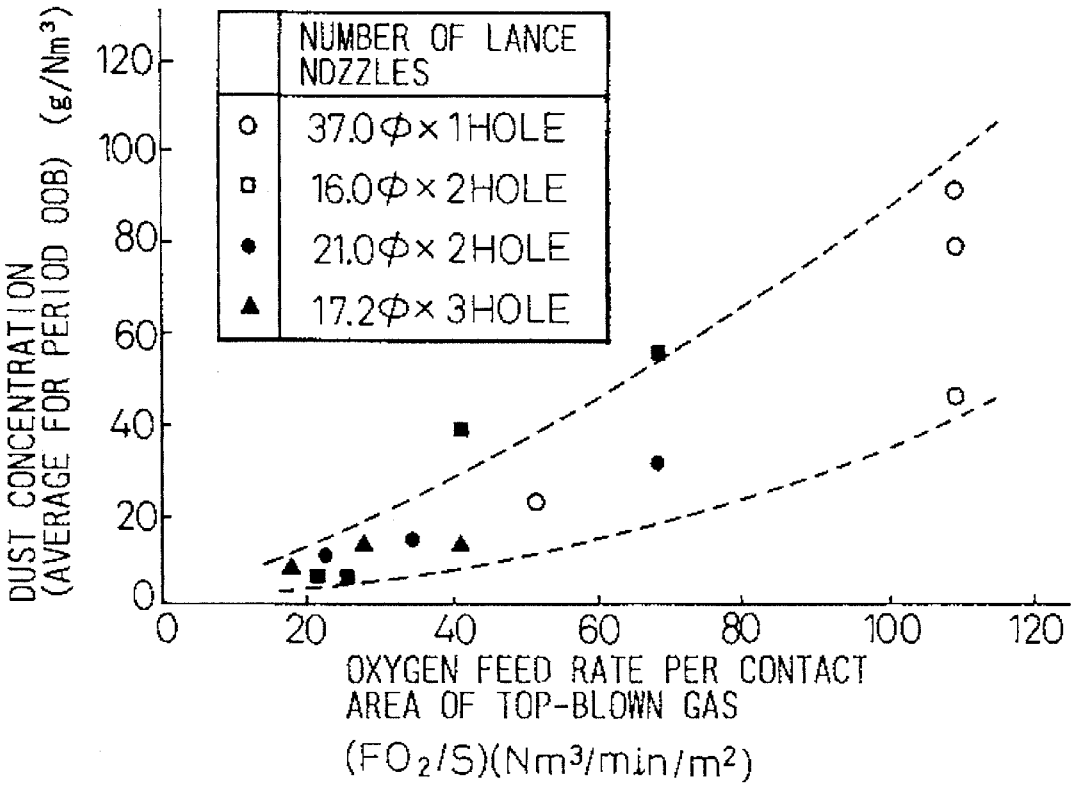
FIG. 11 is a diagram showing the relationship between the dust concentration and the oxygen feed rate per contact area of top-blown gas ($FO_2/S$)

FIG. 11 is a diagram showing the relationship between the $FO_2/S$ and the dust concentration of an exhaust gas. The dust concentration can be arranged using $FO_2/S$, independently of top-blown conditions, and the amount of dust generated can be reduced by regulating the $FO_2/S$ to a low value.

Therefore, in the region where the [C] concentration is not less than 0.5%, the amount of dust generated can be reduced by regulating the $FO_2/S$ value to the lowest possible value (for example, 60 to 80 Nm$^3$/min/m$^2$) while meeting a requirement for an $FO_2/S$ value of not less than 60 Nm$^3$/min/m$^2$ for the purpose of accelerating the decarburization reaction.

On the other hand, in the region where the [C] concentration is in the range of from 0.15 to less than 0.5%, the regulation of the $FO_2/S$ value to the lowest possible value in the range of from 10 to 40 Nm$^3$/min/m$^2$ enables the prevention of dust and the acceleration of decarburization.

Thus, a reduction in the proportion of top-blown gas consumed in secondary combustion, an increase in the amount of oxygen fed to a gas jet contact point formed on the surface of the molten steel, and the regulation of the density of oxygen at the hot spot according to the [C%] of the molten steel enables the dCr/dC to be maintained at a low value even in a region where the [C%] of the molten steel is lower, so that decarburization refining can be carried out with a high decarburization oxygen efficiency, that is, while maintaining the $dC/dO_2$ at a high value. This can shorten the refining time, reduces the unit requirenet of Si for reduction, and, at the same time, can prevent the occurrence of dust and splashing.

Figure 12:
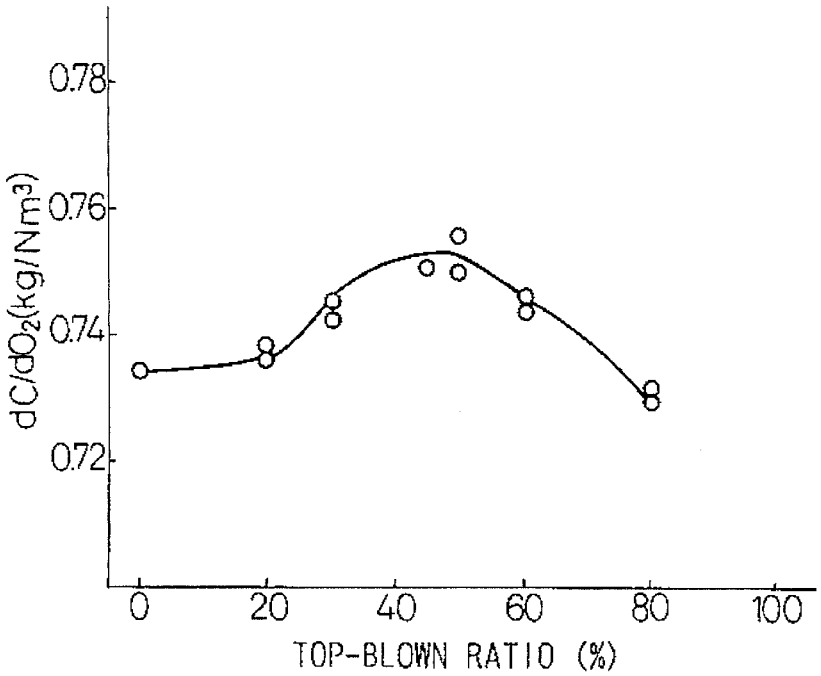
FIG. 12 is a diagram showing the relationship between the top-blown ratio and the $dC/dO_2$.

FIG. 12 is a diagram showing the relationship between the proportion of the amount of the top-blown oxygen in the total amount of the bottom-blown oxygen and the top-blown oxygen (hereinafter referred to as "top-blown ratio"), given by the following equation (12), and the $dC/dO_2$ under conditions of a total oxygen flow rate of 7500 Nm$^3$/hr, a velocity of an oxygen jet blown through a top-blown nozzle of not less than the velocity of sound, $h/d_0$=39, and [C%] in combined-blown region >0.5%.

$$\text{Flow rate of top-blown oxygen}\times 100/(\text{Flow rate of top-blown oxygen}+\text{Flow rate of bottom-blown oxygen}) \quad (12)$$

From FIG. 12, it is apparent that an increase in $dC/dO_2$ is observed when the top-blown ratio is in the range of from 20 to 70%, and the $dC/dO_2$ becomes maximum when the top-blown ratio is in the range of from 40 to 60%, indicating that the oxygen efficiency in decarburization at the hot spot by the top-blown oxygen is high. Further, it is apparent that in order to accelerate the decarburization reaction at the hot spot, bottom blowing, which agitates the molten steel to effectively feed carbon contained in the molten steel to the hot spot is useful.

Figure 13:
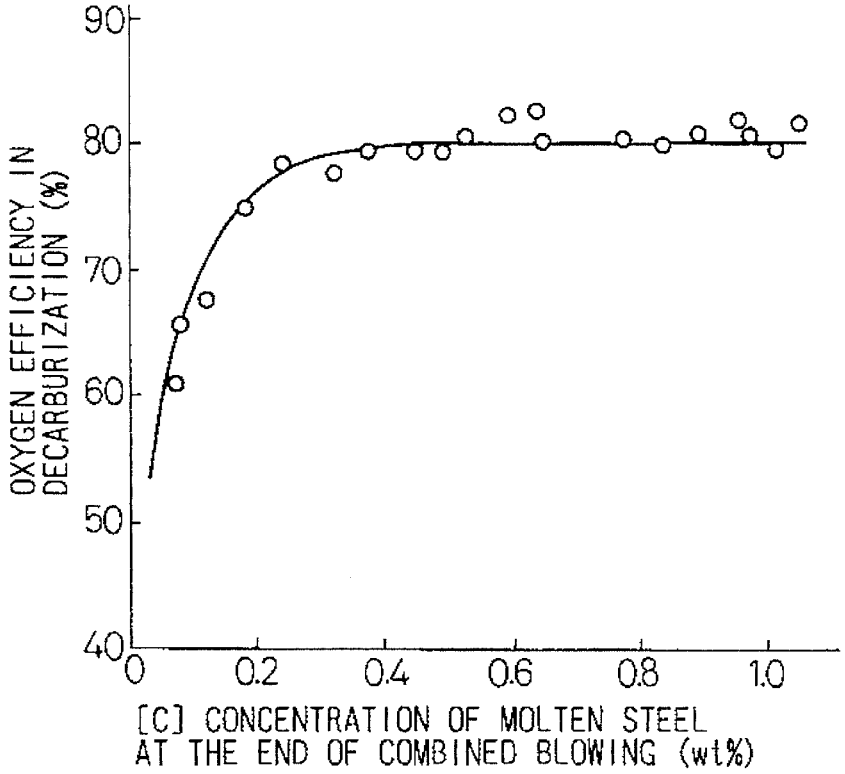
FIG. 13 is a diagram showing the relationship between the [C] concentration of a molten steel at the end of the combined-blown process and the oxygen efficiency in decarburization.

FIG. 13 is a diagram showing the oxygen efficiency in decarburization under conditions of a top-blown ratio of 30% (flow rate of top-blown oxygen: 2,400 Nm$^3$/hr) and combined-blown conditions specified in Table 3 with varied [C] concentrations. From FIG. 13, it is apparent that blowing under conditions specified in the present invention in a [C] concentration of not less than 0.15% provides a high oxygen efficiency in decarburization.

TABLE 3

| | Lance nozzle diameter/ number of holes (mmϕ) | Lance gap (m) | $h/d_0$x (1-β) | Depth of recess on surface of molten steel (mm) | $F_{02}/S$ (Nm$^3$/ min-m$^2$) | Average oxygen efficiency in decarburization ([C] = 0.15 –0.5%) (%) |
|---|---|---|---|---|---|---|
| Ex. of invention | 17.2 × 3 | 2.0 | 60 | 260 | 40 | 77 |

The decarburization reaction of the chromium-containing molten steel, as is apparent from the following equation (13), is influenced by various conditions, including [C] and [Cr] concentrations in the molten steel, the molten steel temperature, and $P_{CO}$ (relating to the amount of oxygen and the mixing ratio of an inert gas blown into the molten steel). Also in the case of the combined-blown process, top-blown conditions should be properly regulated according to the above various conditions. The present inventors have made studies on the above influence of the molten steel temperature by varying the temperature of the molten steel charged into AOD (Argon-Oxygen-Decarburization) to vary the molten steel temperature before the initiation of decarburization in the combined-blown process and, as a result, have found that a further improvement in decarburization efficiency by the combined-blown process can be attained when the molten steel temperature before the initiation of decarburization is above the equilibrium molten steel temperature determined by the equation (13).

$$T=13800/\{8.76-Log([Cr\%]\times P_{CO}/[C\%])\} \quad (13)$$

wherein

T: equilibrium molten steel temperature (K),

[Cr%]: chromium concentration in molten steel (wt.%), $P_{CO}$: partial pressure of CO gas (atm), and

[C%]: carbon concentration in molten steel (wt. %).

The $dC/dO_2$ and the unit requirement of Si for reduction under conditions of a top-blown nozzle of 37 mmø, a single hole, and a Laval nozzle, $h/d_0$=39, L=400, top-blown ratio=30%, and [C%] in combined-blown region>0.5%, (A) in the case where the molten temperature before the initiation of decarburization is above the equilibrium molten steel temperature determined by the equation (13) and (B) in the case where the molten temperature before the initiation of decarburization is below the equilibrium molten steel temperature determined by the equation (13) are given in Table 4.

As is apparent from Table 4, when the molten steel temperature before the initiation of decarburization is above the equilibrium molten steel temperature, both the $dC/dO_2$ and the unit requirenet of Si for reduction can be improved.

TABLE 4

| | Conditions before initiation of decarburization | | | | | Results of operation | |
|---|---|---|---|---|---|---|---|
| | Molten steel [C] (%) | Molten steel [Cr] (%) | Molten steel temp. (°C.) | $P_{co}$* | Equilibrium molten steel temp. (°C.) | $dC/dO_2$ | Unit requirement of Si for reduction (kg/T) |
| (A) | 1.7 | 20.0 | 1525 | 1 | 1511 | 0.740 | 4.6 |
| (B) | 1.7 | 20.0 | 1500 | 1 | 1511 | 0.725 | 5.1 |

*$P_{co}$ was regarded as 1 (i.e., $P_{co}$ = 1) because, in both (A) and (B), both top blowing and bottom blowing were carried out using oxygen alone.

EXAMPLES

Example 1

Figure 14A:
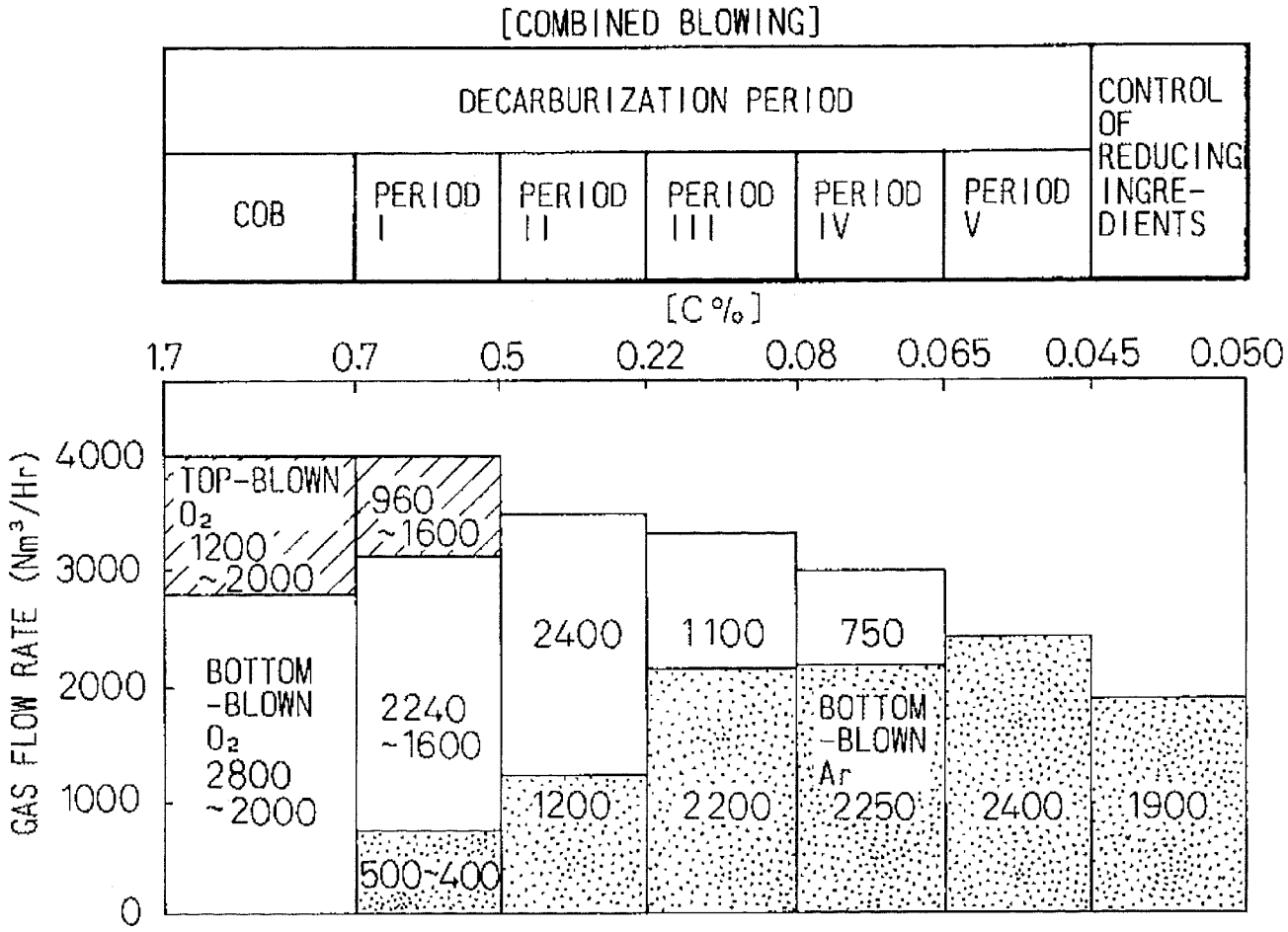
FIG. 14(A) is a diagram showing a blowing pattern in a combined-blown process using a single hole nozzle of a top-blown lance.
Figure 14B:
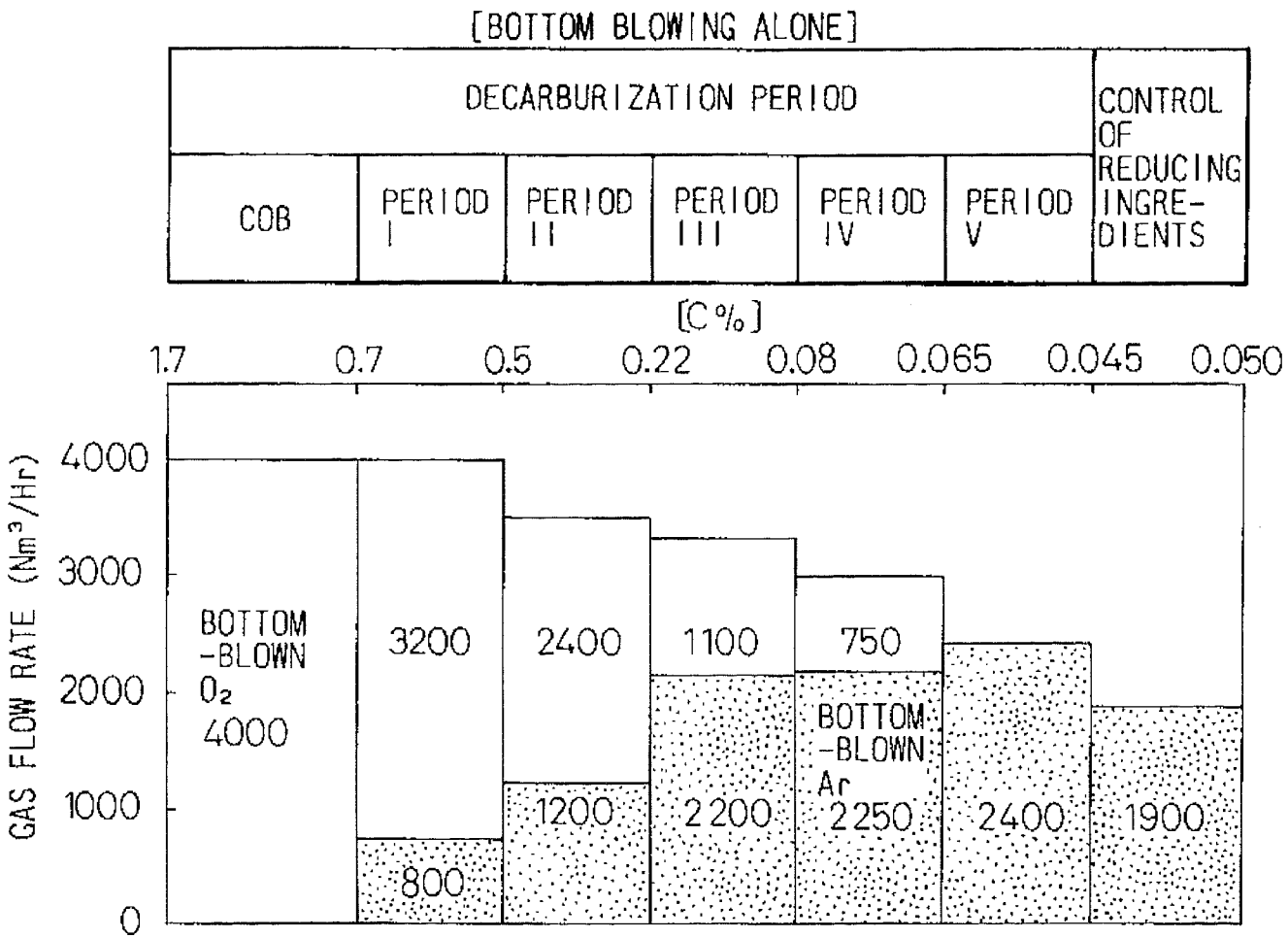
FIG. 14(B) is a diagram showing a blowing pattern in a bottom-blown process.

Decarburization refining of SUS304 stainless steel (18 wt % Cr—8 wt % Ni) 60T was carried out using a combined-blown furnace as shown in FIG. 1(A) according to a combined-blown pattern shown in FIG. 14(A). Before the initiation of decarburization, the carbon concentration of the molten steel was 1.7%, and the molten steel temperature was 1,525° C. The top-blown lance used had a nozzle hole diameter of 22.5 mm and was of a single hole nozzle type. The total oxygen flow rate was kept constant at 1.1 $Nm^3$/T/min. The combined-blown process was continued until the [C] concentration of the molten steel became not less than 0.5%. Thereafter, refining was carried out according to the same blowing pattern as the bottom-blown pattern shown in FIG. 14(B).

The results of an example of the present invention and the results of comparative examples are given in Table 5. From Table 5, it is apparent that, in the example of the present invention, the decarburization efficiency ($dC/dO_2$) and the unit requirenet of Si for reduction could be improved over those in the comparative examples.

Further, for bottom blowing as a comparative example and combined blowing as an example of the present invention under the same conditions as those of Example A, a comparison was made on the percentage secondary combustion, defined by the following equation (14), and the temperature rise rate of the molten steel. As a result, the temperature rise rate of the molten steel in the example of the present invention was not different from that in the comparative example, and the percentage secondary combustion was very low and not more than 5%.

$$\text{Percentage secondary combustion (in furnace gas)}=100CO_2\%/(CO_2\%+CO\%) \quad (14)$$

According to the prior art method, as described in Japanese Unexamined Patent Publication (Kokai) No. 55-158213, in combined blowing, an oxygen-containing gas is blown from above the surface of the molten steel, and CO gas generated from on the surface of the molten steel is positively subjected to secondary combustion to raise the molten steel temperature by taking advantage of heat of reaction represented by the following formula (15), thereby improving the oxygen efficiency in decarburization.

$$CO+\tfrac{1}{2}O_2=CO_2 \quad \Delta H=-67.7\ kcal/mol \quad (15)$$

By contrast, when oxygen is top-blown under combined-blown conditions specified in the present invention, although the secondary combustion reaction occurs, the degree thereof is so low that a temperature rise of the molten steel caused by the heat of the secondary combustion is not recognized. Despite this fact, according to the present invention, the unit requirenet of Si for reduction is reduced. This indicates that the present invention is different from the prior art (Comparative Example B). For Comparative Example C, the $h/d_0$ value was lower than that for Comparative Example B but still exceeded 60, so that the percentage secondary combustion was higher than that in the example of the present invention. Further, the temperature of a hot sot formed on the surface of the molten steel by top-blown oxygen under combined-blown conditions specified in the present invention was measured by the two-color method and found to be as high as 2,400° to 2,500° C. This is considered to suggest that, under combined-blown conditions specified in the present invention, the hot spot is formed on the surface of the molten steel and, at the hot spot, a reaction of chromium oxide, produced by the top-blown oxygen and the bottom-blown oxygen, with the [C] contained in the molten steel, represented by the formula (2) is accelerated. It can be said that the acceleration effect is more significant when the molten steel temperature before the initiation of decarburization is in a preferential decarburization region.

Table 6 shows the results of blowing as an example of the present invention using a top-blown lance having a two-hole nozzle, of which the nozzle hole diameter was 30 mm, the results of blowing another example of the present invention using a top-blown lance having a single hole nozzle, of which the nozzle hole diameter was 37 mm, and the results of bottom blowing as a comparative example.

For Example A of the present invention wherein [C%]= 0.5–0.15%, the $FO_2/S$ value was higher than the $FO_2/S$ range ($FO_2/S$=10–40) specified in the present invention, so that the decarburization effect ($dC/dO_2$) was lower than that for the comparative example. For the other [C] concentrations in the examples of the present invention, the $dC/dO_2$ was equal to or higher than that for the comparative example.

As compared with the comparative example, the examples of the present invention exhibited a reduction in the unit requirenet of Si for reduction of 1 kg/T or more and significantly shortened operation time.

As the amount of dust generated, Example A of the present invention produced twice as much as Example B, indicating that the multihole nozzle had the effect of suppressing the generation of dust.

TABLE 5

| | Bottom blowing (Comp. Ex. A) | Combined blowing (Comp. Ex. B) | Combined (Comp. Ex. C) | Combined blowing (Ex. A of invention) |
|---|---|---|---|---|
| Blowing conditions | | | | |
| Top-blown region flow rate | — | [C] ≧ 0.5% | [C] ≧ 0.5% | [C] ≧ 0.5% |
| Top-blown oxygen flow rate | — | 0.33 $Nm^3/T/min$ | 0.33 $Nm^3/T/min$ | 0.55 $Nm^3/T/min$ |
| Bottom-blown oxygen flow rate | 1.1 $Nm^3/T/min$ | 0.77 $Nm^3/T/min$ | 0.77 $Nm^3/T/min$ | 0.55 $Nm^3/T/min$ |
| Top-blown ratio | 0% | 30% | 30% | 50% |
| Shape of lance nozzle | — | 22.5 mm straight nozzle | 22.5 mm Laval nozzle | 22.5 mm Laval nozzle |
| Lance height | — | 2 m | 2 m | 1.5 m |
| Gas jet velocity | — | ≦330 m/sec | 839 m/sec | 1398 m/sec |
| Depth of recess on surface of molten steel | — | 160 mm* | 160 mm* | 500 mm |
| $h/d_0$ | — | 89* | 75* | 40 |
| [C] before initiation of decarburization | 1.7% | 1.7% | 1.7% | 1.7% |
| Temp. before initiation of decarburization*1 | 1500° C.* | 1500° C.* | 1525° C. | 1525° C. |
| Equilibrium molten steel temp.*2 | 1511° C. | 1511° C. | 1511° C. | 1511° C. |
| Results of operation | | | | |
| $dC/dO_2$ ($kg/Nm^3$)*3 | 0.735 | 0.705 | 0.745 | 0.753 |
| Unit requirement of Si for reduction | 6.3 kg/T | 5.4 kg/T | 4.6 kg/T | 4.1 kg/T |
| Percentage oxygen in secondary combustion*4 | — | 40% | 8% | 5% |
| Temp. rise rate of molten steel | 20° C./min | 20° C./min | 20° C./min | 20° C./min |
| Steelmaking time shortening effect | ▽1 min | Base | ▽1 min | ▽1.5 min |

Note)
*1Temp. before the initiation of decarburization = (temp. at the time of charge into AOD) + (temp. rise due to heat of oxidation of Si)
*2Equilibrium molten steel temp. calculated by the equation (13)
*3$dC/dO_2$ in a period between the initiation of blowing and [C] = 0.5%
*4Percentage secondary combustion calculated by the equation (14)
*Values outside the scope of the invention

Example 2

Figure 15A:
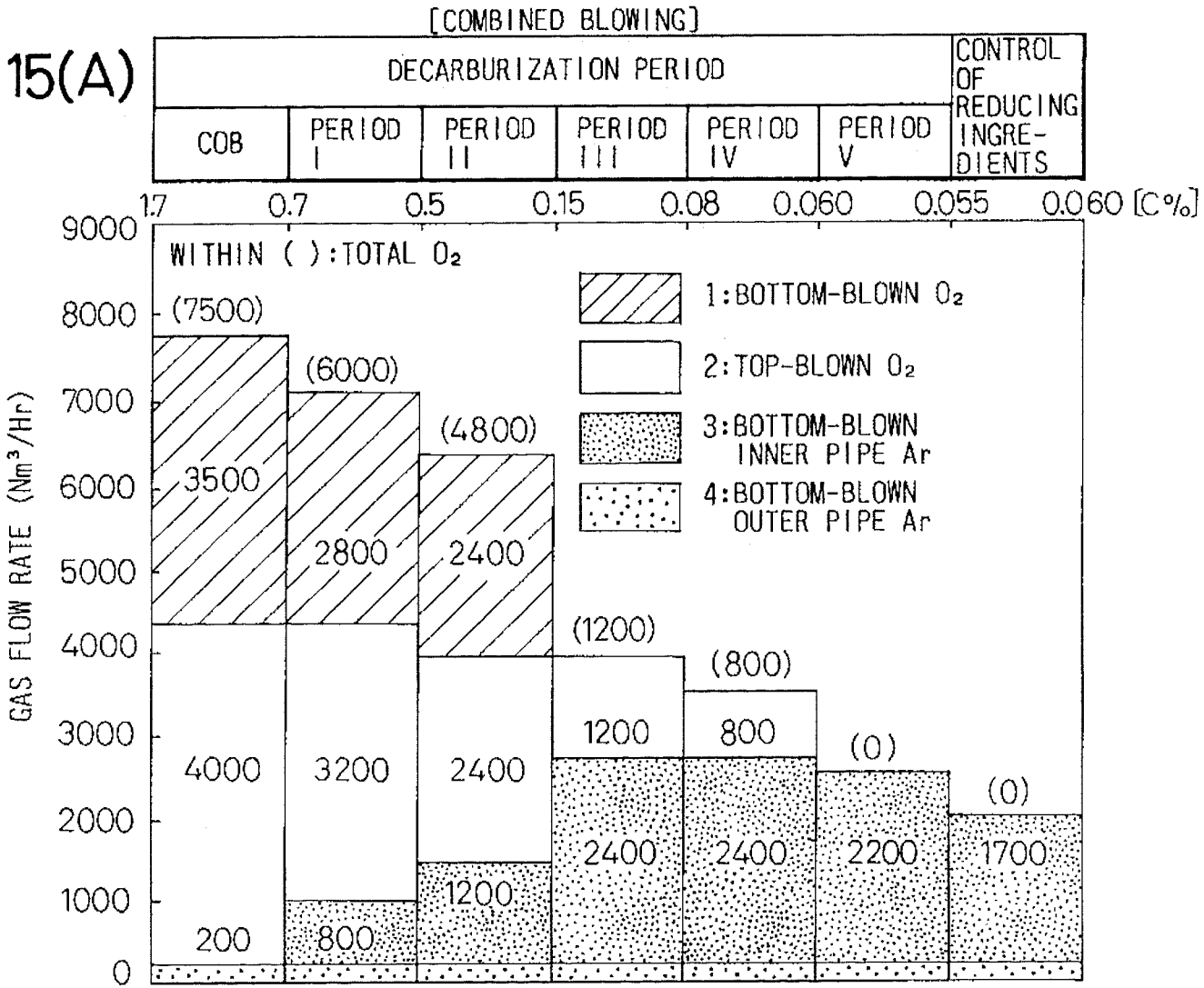
FIG. 15(A) is a diagram showing a blowing pattern in a combined-blown process using a multihole nozzle of a top-blown lance.
Figure 15B:
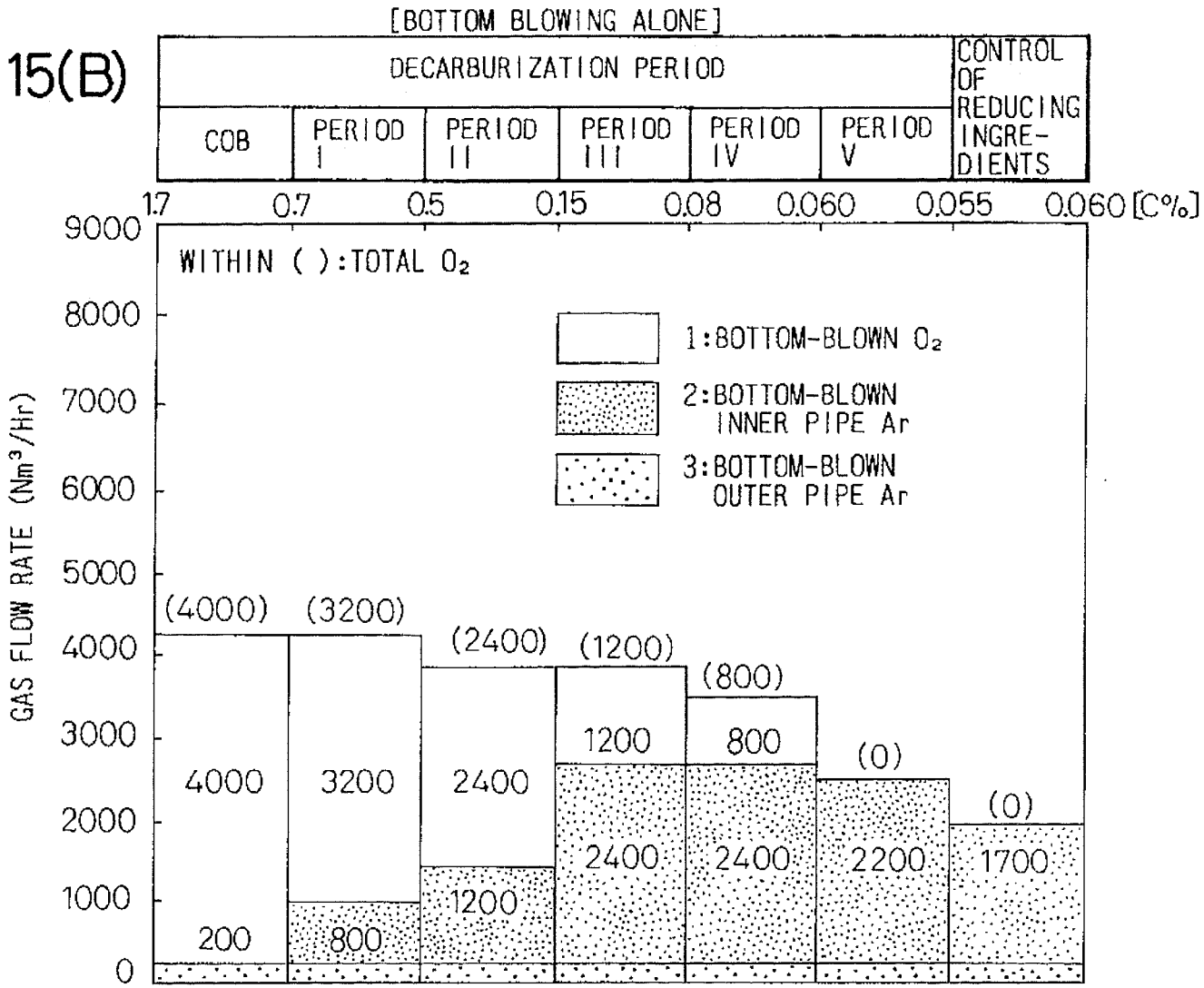
FIG. 15(B) is a diagram showing a blowing pattern in a bottom-blown process.

Decarburization refining of SUS304 stainless steel (18 wt % Cr–8 wt % Ni) 60T was carried out using a combined-blown furnace shown in FIG. 1(A) according to a blowing pattern shown in FIG. 15(A). Before the initiation of decarburization, the carbon concentration of the molten steel was 1.9%, and the molten steel temperature was 1,525° C. Two types of top-blown lances were used. One was of a single-hole nozzle type and had a nozzle hole diameter of 37 mm, and the other was a two-hole nozzle type and had a nozzle hole diameter of 30 mm. The combined-blown process was continued until the [C] concentration of the molten steel became not less than 0.15%. Thereafter, refining was carried out according to the same blowing pattern as the bottom-blown pattern shown in FIG. 15(B).

TABLE 6

| | Bottom blowing (Comp. Ex.) | | Combined blowing (Ex. A of invention) | | Combined blowing (Ex. B of invention) | |
|---|---|---|---|---|---|---|
| Blowing conditions | | | | | | |
| Top-blown region | — | | ≧0.15% | | ≧0.15% | |
| Top-blown oxygen flow rate ($Nm^3/T/min$) | — | | ≧0.5% 0.97–0.78 | 0.5–0.15% 0.67 | ≧0.5% 0.97–0.78 | 0.5–0.15% 0.67 |
| Bottom-blown oxygen flow rate ($Nm^3/T/min$) | 1.1 | | 1.1–0.89 | 0.67 | 1.1–0.89 | 0.67 |
| Shape of lance nozzle | — | | 37.0 mmϕ × 1 hole | | 30.0 mmϕ × 2 holes | |
| Lance height (H) | — | | 2 m | | 2 m | |
| $h/d_0$ | — | | 39 | 45 | 57 | 60 |
| Depth of recess on bath surface (L) | — | | 395 mm | 220 mm | 355 mm | 190 mm |
| $F0_2/S$ ($Nm^3/min/m^2$) | — | | 145 | 77* | 70 | 40 |
| Before initiation of decarburization | 1525° C. | | 1525° C. | | 1525° C. | |
| Results of operation | | | | | | |
| $dC/dO_2$ ($kg/Nm^3$) | ≧0.5% 0.789 | 0.5–0.15% 0.700 | ≧0.5% 0.820 | 0.5–0.15% 0.618 | ≧0.5% 0.820 | 0.5–0.15% 0.700 |
| Percentage oxygen in secondary combustion*[1] | — | | 4.7% | | 5.5% | |
| Unit requirement of Si for reduction | 6.7 kg/T | | 5.7 kg/T | | 5.1 kg/T | |
| Steelmaking time shortening effect | Base | | ▽10 min | | ▽11 min | |
| Amount of dust generated | 5 kg/T | | 20 kg/T | | 10 kg/T | |

Note)
*[1]Percentage secondary combustion (in furnace gas) = 100 $CO_2$ %/($CO_2$ % + CO %)
*Values outside the scope of invention As is apparent from the foregoing description, according to the present invention, in refining a chromium-containing molten steel by decarburization, the decarburization efficiency and the decarburization rate can be improved under the same oxygen gas feed rate conditions. Therefore, the necessary amount of Si for reduction of chromium oxide can be reduced, and the unit requirenet of oxygen gas and a diluting gas can be improved. At the same time, the decarburization refining time can be shortened, resulting in a reduction in refining cost, such as prolongation of service life of a refining furnace, and improved productivity. Further, the occurrence of dust and splash by top blowing can be prevented, enabling an increase in the yield of molten steel and a reduction in production problems associated with work for removing splash deposited on an inlet of the furnace.

What is claimed is:

1. A method for refining a molten chromium-containing steel by decarburization, comprising blowing an oxidizing gas into a molten chromium-containing steel through a top-blown lance and a bottom-blown tuyere to decarburize said molten steel, said gas being blown onto the surface of said molten steel through said top-blown lance under the following conditions:

said molten steel has a carbon concentration of not less than 0.15%;

the velocity of the gas immediately after spouting through a nozzle hole of said top-blown lance is not less than a velocity of sound; and the velocity of the gas jetted through said nozzle hole of the top-blown lance is less than the velocity of sound in the vicinity of the surface of the molten steel with the ratio of the length h of a zone, where the gas jet velocity is less than the sound velocity, to the minimum hole diameter $d_0$ of said nozzle, $h/d_0$, being not more than 60.

2. The method according to claim 1, wherein the oxidizing gas blown onto the surface of said molten chromium-containing steel is oxygen.

3. The method according to claim 1, wherein the gas blown onto the surface of said molten chromium-containing steel is a oxidizing gas mixture of oxygen with an inert gas.

4. The method according to claim 1, which further comprises configuring said top-blown lance to have a single-hole nozzle to form a hot spot on the surface of the molten steel.

5. A method for refining a molten chromium-containing steel by decarburization, comprising blowing an oxidizing gas into a molten chromium-containing steel through a top-blown lance and a bottom-blown tuyere to decarburize said molten steel, said gas being blown onto the surface of said molten steel through a top-blown lance comprising a multihole nozzle under the following conditions:

said molten steel has a carbon concentration of not less than 0.15%;

the velocity of the gas immediately after spouting through each nozzle hole of said top-blown lance is not less than the velocity of sound; and the velocity of the gas jetted through said each nozzle hole of the top-blown lance is less than the velocity of sound in the vicinity of the surface of the molten steel with the length h of a zone, where the gas jet velocity is less than the velocity of sound, and the minimum hole diameter $d_0$ of said each nozzle meeting a requirement represented by the formula $h/d_0 \times (1-\beta) \leqq 60$ wherein β represents a degree of overlap, between gas jets on the surface of the molten steel, defined by the following equation:

$$\beta=(l_0N-l)/N/l_o$$

wherein $l_0$: perimeter of a gas jet contact plane formed on the surface of a molten steel by a gas jet blown through one nozzle;

N: number of nozzle holes; and l: perimeter of a gas jet contact plane formed on the surface of a molten steel by gas jets blown through all nozzles.

6. The method according to claim 5, wherein the gas blown into said molten chromium-containing steel is oxygen.

7. The method according to claim 5, wherein the oxidizing gas blown into said molten chromium-containing steel is a oxidizing gas mixture of oxygen with an inert gas.

8. The method according to claim 1 or 5, wherein the temperature of the molten steel at the beginning of blowing of the oxidizing gas through said top-blown lance is regulated to a value above an equilibrium molten steel temperature T represented by the following equation:

$$T=13800/\{8.76-Log([Cr\%]\times P_{CO}/[C\%])\}$$

wherein

T: equilibrium molten steel temperature;

[Cr%]: chromium concentration in the molten steel (wt. %)

$P_{CO}$ : partial pressure of CO gas (atm); and

[C%]: carbon concentration in the molten steel (wt. %).

9. The method according to claim 1 or 5, wherein the proportion of the amount of oxygen blown through said top-blown lance to the total amount of oxygen blown through said top-blown lance and said bottom blown tuyere is 20 to 70%.

10. The method according to claim 1 or 5, wherein the depth L of a recess formed on the surface of said molten steel by the gas jet blown through said top-blown lance is regulated by regulating the jet gas pressure so as to meet the following requirements depending upon the carbon concentration of said molten steel:

the depth L of the recess on the surface of said molten steel is regulated to not less than 300 mm in a region where the carbon concentration of the molten steel is not less than 0.5%; and the depth L of the recess on the surface of said molten steel is regulated to 70 to 300 mm in a region where the carbon concentration of the molten steel is not less than 0.15 to less than 0.5%.

11. The method according to claim 1 or 5, wherein the ratio of the flow rate $FO_2$ of oxygen in the gas jet blown through said top-blown lance, said oxygen causing a decarburization reaction on the surface of said molten steel, to the area S of contact between said gas jet and the surface of said molten steel, $FO_2/S$, is regulated by regulating the oxygen flow rate of said jet gas so as to meet the following requirements depending upon the carbon concentration of said molten steel:

the $FO_2/S$ value is regulated to not less than 60 $Nm^3/min/m^2$ in a region where the carbon concentration of the molten steel is not less than 0.5%; and the $FO_2/S$ value is regulated to 10 to 40 $Nm^3/min/m^2$ in a region where the carbon concentration of the molten steel is not less than 0.15 to less than 0.5%.

12. The method according to claim 1 or 5, which further comprises configuring said nozzle hole of said top-blown lance to have a divergent shape to reduce the amount of oxygen consumed in secondary combustion.

13. The method according to claim 1 or 5, which further comprises cooling said top-blown lance with a water-cooling mechanism to accurately maintain lance gap H.

14. The method of claim 1 or 5 wherein the molten steel contains at least about 18% by weight of chromium.

15. The method according to claim 1, which further comprises configuring said top-blown lance to have a multihole nozzle to increase the gas jet contact area on the surface of the molten steel.

* * * * *